US009651883B2

(12) United States Patent
Hama et al.

(10) Patent No.: US 9,651,883 B2
(45) Date of Patent: May 16, 2017

(54) TONER

(71) Applicant: CANON KABUSHIKI KAISHA, Tokyo (JP)

(72) Inventors: Masayuki Hama, Toride (JP); Ichiro Kanno, Kashiwa (JP); Takeshi Hashimoto, Moriya (JP); Nozomu Komatsu, Toride (JP); Takakuni Kobori, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/179,489

(22) Filed: Jun. 10, 2016

(65) Prior Publication Data

US 2016/0363878 A1 Dec. 15, 2016

(30) Foreign Application Priority Data

Jun. 15, 2015 (JP) ..... 2015-120215

(51) Int. Cl.

| | |
|---|---|
| ***G03G 9/097*** | (2006.01) |
| ***G03G 9/087*** | (2006.01) |
| ***G03G 9/08*** | (2006.01) |

(52) U.S. Cl.

CPC ..... *G03G 9/08755* (2013.01); *G03G 9/0819* (2013.01); *G03G 9/0825* (2013.01); *G03G 9/08782* (2013.01); *G03G 9/08797* (2013.01)

(58) Field of Classification Search

CPC ..... G03G 9/0825; G03G 9/08755

See application file for complete search history.

(56) References Cited

U.S. PATENT DOCUMENTS

| | | | |
|---|---|---|---|
| 5,424,810 | A | 6/1995 | Tomiyama et al. |
| 5,464,722 | A | 11/1995 | Tomiyama et al. |
| 5,700,616 | A | 12/1997 | Kasuya et al. |
| 5,712,073 | A | 1/1998 | Katada et al. |
| 5,968,701 | A | 10/1999 | Onuma et al. |

(Continued)

FOREIGN PATENT DOCUMENTS

| | | | |
|---|---|---|---|
| JP | 2004-279476 | A | 10/2004 |
| JP | 2011-145587 | A | 7/2011 |

(Continued)

OTHER PUBLICATIONS

U.S. Appl. No. 15/176,541, Masayuki Hama, filed Jun. 8, 2016.

*Primary Examiner* — Peter Vajda

(74) *Attorney, Agent, or Firm* — Fitzpatrick Cella Harper and Scinto

(57) ABSTRACT

A toner comprising a toner particle containing an amorphous polyester resin, a crystalline polyester resin and a wax, wherein in a cross-section of the toner by transmission electron microscopy (TEM), domains of the wax and crystals of the crystalline polyester resin are present, the area occupied by the domains of the wax is 0.5% to 8.0% and the area occupied by the crystals of the crystalline polyester resin is 0.5% to 8.0% of the cross-sectional area of the toner, the number-average diameter Dw of the domains of the wax is 60 nm to 240 nm, the aspect ratio of the crystals of the crystalline polyester resin is 5.0 to 25.0, and the number-average diameter Dc of major axis lengths of the crystals of the crystalline polyester resin is 0.8 to 2.0 times the Dw.

5 Claims, 3 Drawing Sheets

(56) References Cited

U.S. PATENT DOCUMENTS

| | | | |
|---|---|---|---|
| 5,972,553 | A | 10/1999 | Katada et al. |
| 6,002,895 | A | 12/1999 | Kasuya et al. |
| 6,007,957 | A | 12/1999 | Kobori et al. |
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,430,384 | B2 | 8/2002 | Hama et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 7,112,395 | B2 | 9/2006 | Ida et al. |
| 7,135,263 | B2 | 11/2006 | Kawakami et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,855,042 | B2 | 12/2010 | Kobori et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,524,434 | B2 | 9/2013 | Tominaga et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,256,148 | B2 | 2/2016 | Fujikawa et al. |
| 9,348,253 | B2 | 5/2016 | Kanno et al. |
| 9,372,420 | B2 | 6/2016 | Mizo et al. |
| 2009/0197190 | A1 | 8/2009 | Nakamura et al. |
| 2010/0028796 | A1 | 2/2010 | Nakamura et al. |
| 2010/0183971 | A1 | 7/2010 | Fujikawa et al. |
| 2011/0151368 | A1* | 6/2011 | Hong ..... G03G 9/0819 430/108.8 |
| 2013/0244159 | A1 | 9/2013 | Ishigami et al. |
| 2013/0288173 | A1 | 10/2013 | Hashimoto et al. |
| 2014/0096409 | A1 | 4/2014 | Ohtsu et al. |
| 2014/0101966 | A1 | 4/2014 | Minagawa et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0072277 | A1 | 3/2015 | Sugiura et al. |
| 2015/0086917 | A1 | 3/2015 | Iwasaki et al. |
| 2015/0177634 | A1 | 6/2015 | Kamae et al. |
| 2015/0185650 | A1 | 7/2015 | Hashimoto et al. |
| 2015/0309443 | A1 | 10/2015 | Kobori et al. |
| 2016/0109820 | A1 | 4/2016 | Hashimoto et al. |

FOREIGN PATENT DOCUMENTS

| | | | |
|---|---|---|---|
| JP | 2012-018391 | A | 1/2012 |
| JP | 2012-063559 | A | 3/2012 |

* cited by examiner

TONER

BACKGROUND OF THE INVENTION

Field of the Invention

The present invention relates to a toner for use in electrophotographic systems, electrostatic recording systems, electrostatic printing systems and toner jet systems.

Description of the Related Art

As electrophotographic full-color copiers have become popular in recent years, there has been increasing demand for higher printing speeds and energy savings. To achieve higher printing speeds, techniques are being investigated for melting the toner more rapidly during the fixing process. Further, to save energy, techniques are being investigated for fixing the toner at lower fixation temperatures so as to reduce power consumption during the fixing process.

Methods for improving the low-temperature fixability of the toner that are compatible with high-speed printing include lowering the glass transition point or softening point of the binder resin in the toner, and using a binder resin with a sharp melt property. In recent years, toners containing crystalline polyester resin in the binder resin have been developed as a way of further improving the sharp melt property. Because a toner containing a crystalline polyester melts rapidly at the fixation temperature but maintains its hardness at temperatures up to the fixation temperature, it can have improved storage stability and durability.

In the case of toners containing crystalline polyester, various techniques relating to the state of the crystalline polyester in the toner have been proposed.

In the technique disclosed in Japanese Patent Application Laid-open No. 2011-145587, the area of the domains of the crystalline polyester in the toner is 0.2 to 0.8 times the area of the domains of the wax in a cross-section of a toner containing a crystalline polyester and a wax. It has been shown that with this technique, toner breakage is reduced and the resulting toner is very durable. Moreover, the speed at which the wax seeps to the surface of the toner is optimally balanced with the melting speed of the toner binder resin, resulting in both low-temperature fixability and good fixing separability.

In Japanese Patent Application Laid-open No. 2012-63559, a crystalline polyester dispersing agent is used in addition to the principal binder resin and crystalline polyester, and the solubility parameters of each are defined. The object here is to reduce exposure of the crystalline polyester on the surface layer of the toner, and finely disperse the crystalline polyester inside the toner particles, thereby suppressing toner filming on other members and improving hot offset resistance.

Japanese Patent Application Laid-open No. 2012-18391 proposes a toner containing a finely dispersed crystalline resin, with an amorphous resin coated on the surface layer of the toner particles. Heat-resistant storability, durability and stability are thus achieved in a toner with excellent low-temperature fixability containing a crystalline polyester.

Japanese Patent Application Laid-open No. 2004-279476 proposes improving hot offset resistance by giving the crystals of the crystalline polyester in the toner a major axis diameter of at least 0.5 μm and no more than ½ the diameter of the toner.

SUMMARY OF THE INVENTION

Although techniques have been studied for controlling damage while improving the low-temperature fixability of a toner by adding a crystalline polyester as discussed above, evaluations of long-term image output durability under low-temperature fixing conditions have revealed serious problems of toner contamination of the fixing member.

It is an object of the present invention to provide a toner that solves these problems. Specifically, the object is to provide a toner capable of good long-term image formation with little contamination of the fixing member during low-temperature fixing.

The present invention is a toner comprising a toner particle containing an amorphous polyester resin, a crystalline polyester resin and a wax, wherein in a cross-section of the toner by transmission electron microscopy (TEM), domains of the wax and crystals of the crystalline polyester resin are present, the area occupied by the domains of the wax is from 0.5% to 8.0% and the area occupied by the crystals of the crystalline polyester resin is from 0.5% to 8.0% of the cross-sectional area of the toner, the number-average diameter (Dw) of the domains of the wax is from 60 nm to 240 nm, the aspect ratio of the crystals of the crystalline polyester resin is from 5.0 to 25.0, and the number-average diameter (Dc) of major axis lengths of the crystals of the crystalline polyester resin is from 0.8 to 2.0 times the number-average diameter (Dw) of the domains of the wax.

The present invention can provide a toner having low-temperature fixability whereby it is possible to save energy by reducing power consumption in a fixing apparatus, while at the same time controlling contamination of the fixing member even during low-temperature fixing with a continuous paper feed, thereby extending the life of the fixing apparatus.

Further features of the present invention will become apparent from the following description of exemplary embodiments (with reference to the attached drawings).

DESCRIPTION OF THE EMBODIMENTS

Figure 1:
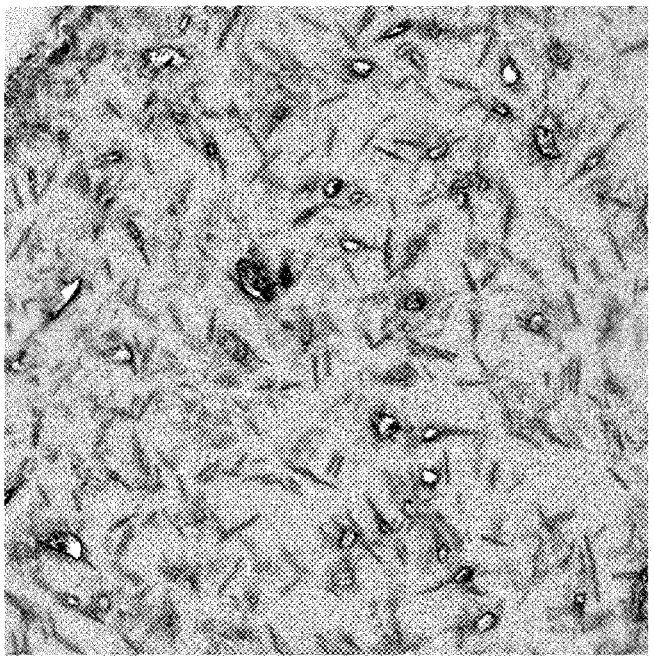
FIG. 1 shows a cross-section of the toner of the present invention under a transmission electron microscope.

In the toner of the present invention, crystals of a crystalline polyester resin and domains of a wax are present (preferably dispersed) in a toner cross-section. It is important that the number-average diameter (sometimes called "Dc" below) of the major axis lengths of the crystals of the crystalline polyester resin be 0.8 to 2.0 times the number-average diameter (sometimes called "Dw" below) of the domains of the wax. It has been confirmed that offset (cold offset) of the toner on the fixing member during low-temperature fixing can be controlled if a toner is prepared that fulfills these conditions.

The mechanism here is thought to be that the wax as a whole is more likely to permeate the molten domains of the crystalline polyester resin as the resin melts during low-temperature fixing, facilitating conduction of the wax to the surface of the toner. In fact, a large wax seepage effect due to the presence of a crystalline polyester resin has been confirmed in the high-temperature fixing range, but with the toner of the present invention this effect is greater in the low-temperature fixing range. The number-average diameter Dc is preferably 1.0 to 1.5 times the Dw.

A feature of the toner particles of the present invention is that they contain an amorphous polyester resin, a crystalline polyester resin and a wax.

(Amorphous Polyester Resin)

The toner of the invention contains an amorphous polyester resin as a binder resin. This amorphous polyester resin preferably comprises a polyester resin A with a small weight-average molecular weight consisting primarily of an aromatic diol, and a polyester resin B with a large weight-average molecular weight consisting primarily of an aromatic diol. The weight-average molecular weight (Mw) of the polyester resin A is preferably 3000 to 10000. The weight-average molecular weight (Mw) of the polyester resin B is preferably 30000 to 300000.

Using two polyesters with different weight-average molecular weights as binder resins, it is possible to improve the low-temperature fixability of the toner due to the effect of the low-weight-average-molecular-weight polyester, while improving hot offset resistance due to the effect of the high-weight-average-molecular-weight polyester.

The sum of the contents of the polyester resin A and polyester resin B in the toner particles is preferably 60% to 99% by mass.

In the present invention, the content ratio (A/B) of the polyester resin B relative to the polyester resin A is from 60/40 to 80/20 by mass. A good balance of low-temperature fixability and hot offset resistance can be achieved if (A/B) is within this range.

Both the polyester resin A and polyester resin B preferably have polyvalent alcohol units and polyvalent carboxylic acid units. In the invention, a polyvalent alcohol unit is a constituent derived from a polyvalent alcohol component used in condensation polymerization of the polyester. In the invention, a polyvalent carboxylic acid unit is a constituent derived from a polyvalent carboxylic acid or anhydride or lower alkyl ester thereof used in condensation polymerization of the polyester.

Preferably both the polyester A and the polyester B in the invention have polyvalent alcohol units and polyvalent carboxylic acid units, and polyvalent alcohol units derived from an aromatic diol constitute 90 mol % to 100 mol % of the total moles of the polyvalent alcohol units. Fogging can be controlled if the polyvalent alcohol units derived from an aromatic diol constitute at least 90 mol % of the total moles of the polyvalent alcohol units.

The fact that the polyvalent alcohol units of the polyester resin A have a structure derived from an aromatic diol in common with polyester B makes them more compatible and improves the dispersibility of the polyester A and polyester B.

Examples of components derived from aromatic diols include the bisphenol represented by Formula (1), and derivatives thereof.

(1)

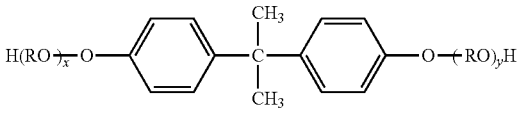

[in the formula, R is an ethylene or propylene group, each of x and y is 0 or an integer greater than 0, and the average of x+y is 0 to 10.

It is desirable that the R values of the polyester resin A and polyester resin B in the Formula (1) be the same because this makes them more compatible during melt kneading. A bisphenol A propylene oxide adduct in which R is a propylene group in both cases and the average of x+y is 2 to 4 for example is desirable from the standpoint of charge stability.

(Amorphous Polyester Resin A)

Preferably the amorphous polyester resin A of the present invention has polyvalent alcohol units and polyvalent carboxylic acid units, and polyvalent alcohol units derived from an aromatic diol constitute 90 mol % to 100 mol % of the total moles of the polyvalent alcohol units. Fogging can be controlled if the polyvalent alcohol units derived from an aromatic diol constitute at least 90 mol % of the total moles of the polyvalent alcohol units. To ensure compatibility with the polyester B in the present invention, they preferably constitute at least 95 mol %, or more preferably 100 mol %.

The following polyvalent alcohol components may be used as components other than the aromatic diol forming the polyvalent alcohol units of the polyester resin A: ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylol ethane, trimethylol propane, 1,3,5-trihydroxymethyl benzene.

In the polyester resin A of the present invention, polyvalent carboxylic acid units derived from an aromatic dicarboxylic acid or derivative thereof preferably constitute 90 mol % to 99.9 mol % of the total moles of the polyvalent carboxylic acid units.

If the percentage of polyvalent carboxylic units derived from an aromatic dicarboxylic acid or derivative thereof is within this range, compatibility with the polyester A is improved, and it is possible to control concentration fluctuation and fogging after long-term printing.

Examples of the aromatic dicarboxylic acid or derivative thereof include aromatic dicarboxylic acids such as phthalic acid, isophthalic acid and terephthalic acid, and their anhydrides.

Moreover, including polyvalent carboxylic acid units derived from an aliphatic dicarboxylic acid or derivative thereof in the amount of 0.1 mol % to 10.0 mol % of the total moles of the polyvalent carboxylic acid units is desirable for further improving the low-temperature fixability of the toner.

Examples of aliphatic dicarboxylic acids or their derivatives include alkyldicarboxylic acids such as succinic acid, adipic acid, sebacic acid, and azelaic acid, or their anhydrides; succinic acids substituted with $C_{6-18}$ alkyl or alkenyl groups, or their anhydrides; and unsaturated dicarboxylic acids such as fumaric acid, maleic acid, and citraconic acid, or their anhydrides. Of these, succinic acid, adipic acid, fumaric acid and their acid anhydrides and lower alkyl esters are desirable.

Examples of polyvalent carboxylic acid units other than these include trivalent or tetravalent carboxylic acids such as trimellitic acid, pyromellitic acid, benzophenonetetracarboxylic acid and their anhydrides and the like.

(Amorphous Polyester Resin B)

In addition to the above mentioned aromatic diols and oxyalkylene ethers of phenolic novolac resins, polyvalent alcohol components similar to those in the crystalline polyester resin A can be used as components of the polyvalent alcohol units of the amorphous polyester resin B.

For purposes of improving the dispersibility of the resins with each other, the amorphous polyester resin B of the invention preferably contains polyvalent carboxylic acid units derived from an aliphatic dicarboxylic acid having a $C_{4-16}$ linear hydrocarbon as the principal chain with carboxyl groups at both ends, in the amount of 15 mol % to 50 mol % of the total moles of the polyvalent carboxylic acid units.

When the aliphatic dicarboxylic acid having a $C_{4-16}$ linear hydrocarbon as the principal chain with carboxyl groups at both ends reacts with the alcohol component, the principal chain acquires a partially flexible structure due to the linear hydrocarbon structure in the principal chain of the polyester. Therefore, in the toner melt kneading step when an amorphous polyester resin A with a low softening point is mixed with this amorphous polyester B having a high softening point originating in this flexible structure, the amorphous polyester resin B entwines with the principal chains of the amorphous polyester resin A, improving its dispersibility and also improving the dispersibility of the crystalline polyester resin.

Examples of the aliphatic dicarboxylic acid having a $C_{4-16}$ linear hydrocarbon as the principal chain with carboxyl groups at both ends include alkyldicarboxylic acids such as adipic acid, azelaic acid, sebacic acid, tetradecanedioic acid, and octadecanedioic acid, and their anhydrides and lower alkyl esters. Other examples include such compounds having branched structures with methyl, ethyl, octyl or other alkyl groups or alkylene groups in a part of the principal chain. The number of carbon atoms in the linear hydrocarbon is preferably 4 to 12, or more preferably 4 to 10.

Examples of the other polyvalent carboxylic acid units included in the polyester resin B include aromatic dicarboxylic acids such as phthalic acid, isophthalic acid, and terephthalic acid, and their anhydrides; succinic acids substituted with $C_{6-18}$ alkyl or alkenyl groups, or their anhydrides; and unsaturated dicarboxylic acids such as fumaric acid, maleic acid, and citraconic acid, or their anhydrides. Of these, a carboxylic acid or derivative thereof with an aromatic ring, such as terephthalic acid, isophthalic acid, trimellitic acid, pyromellitic acid, benzophenontetracarboxylic acid or their anhydrides, is preferred for ease of improving hot offset resistance.

(Other Binder Resin)

In addition to the polyester resin A and polyester resin B described above, the polymer D described below may be added as a binder resin in the toner of the invention in an amount that does not inhibit the effects of the invention with the aim of improving pigment dispersibility or increasing the charge stability or blocking resistance of the toner.

The polymer D has a structure comprising a hydrocarbon compound bound to a vinyl resin component. This polymer D is preferably a polymer comprising a polyolefin bound to a vinyl resin component, or a polymer having a vinyl resin component comprising a vinyl monomer bound to a polyolefin. It is thought that this polymer D increases the affinity between the polyester resin and the wax. This contributes to improving gloss uniformity by thoroughly controlling seepage of wax to the outermost toner surface at inorganic fine particle sites even when the temperature is high on the surface of the fixing unit.

The content of the polymer D per 100 mass parts of the amorphous polyester resin is preferably 2 to 10 mass parts, or more preferably 3 to 8 mass parts. Gloss uniformity can be further improved while maintaining the low-temperature fixability of the toner if the content of the polymer D is within this range.

The polyolefin in the polymer D is not particularly limited as long as it is a polymer or copolymer of an unsaturated hydrocarbon monomer having one double bond, and various polyolefins may be used. A polyethylene or polypropylene polyolefin is especially desirable.

The following are examples of vinyl monomers for use in the vinyl resin component of the polymer D:

styrene monomers such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene, and their derivatives;

α-methylene aliphatic monocarboxylic acid esters containing amino groups such as dimethylaminoethyl methacrylate and diethylaminoethyl methacrylate; and vinyl monomers containing N atoms such as acrylonitrile, methacrylonitrile, acrylamide and other acrylic acid and methacrylic acid derivatives;

unsaturated dibasic acids such as maleic acid, citraconic acid, itaconic acid, alkenylsuccinic acid, fumaric acid and mesaconic acid; unsaturated dibasic acid anhydrides such as maleic anhydride, citraconic anhydride, itaconic anhydride and alkenylsuccinic anhydride; unsaturated dibasic acid half esters such as maleic methyl half ester, maleic ethyl half ester, maleic butyl half ester, citraconic methyl half ester, citraconic ethyl half ester, citraconic butyl half ester, itaconic methyl half ester, alkenylsuccinic methyl half ester, fumaric methyl half ester and mesaconic methyl half ester; unsaturated dibasic acid esters such as dimethylmaleic acid and dimethylfumaric acid; α,β-unsaturated acids such as acrylic acid, methacrylic acid, crotonic acid and cinnamic acid; α,β-unsaturated acid anhydrides such as crotonic acid anhydride and cinnamic acid anhydride, and anhydrides of these α,β-unsaturated acids with lower fatty acids; vinyl monomers containing carboxyl groups such as alkenylmalonic acid, alkenylglutaric acid, alkenyladipic acid and their anhydrides and monoesters;

acrylic or methacrylic acid esters such as 2-hydroxyethyl acrylate, 2-hydroxyethyl methacrylate and 2-hydroxypropyl methacrylate; vinyl monomers containing hydroxyl groups such as 4-(1-hydroxy-1-methylbutyl) styrene and 4-(1-hydroxy-1-methylhexyl)styrene;

acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; and methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate and other α-methylene aliphatic monocarboxylic acid esters.

For use in the present invention, the polymer D having a structure resulting from the reaction of a vinyl resin component and a hydrocarbon compound can be obtained by known methods, such as by a reaction between the vinyl monomers described above or a reaction between one polymer and the monomer raw material of the other polymer.

The structural units of the vinyl resin component preferably include styrene units, ester units and also acrylonitrile units or methacrylonitrile units.

In the present invention, another resin is preferably included in the toner as a dispersing agent so as to improve the dispersibility of the release agent and pigment, and also help to improve the dispersibility of the fine crystals of crystalline polyester resin on the surface.

Other resins that can be used as binder resins in the toner of the invention include the following resins for example: single polymers of styrene and substituted styrene such as polystyrene, poly-p-chlorostyrene and polyvinyl toluene; styrene copolymers such as styrene-p-chlorostyrene copolymer, styrene-vinyl toluene copolymer, styrene-vinyl naphthaline copolymer, styrene-acrylic ester copolymer, styrene-methacrylic ester copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; polyvinyl chloride, phenolic resin, natural denatured phenolic resin, natural resin-denatured maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin, petroleum resin and the like.

(Wax (Release Agent))

The following are examples of the wax used in the toner of the invention: hydrocarbon waxes such as low-molecular-weight polyethylene, low-molecular-weight polypropylene, alkylene copolymer, microcrystalline wax, paraffin wax and Fischer-Tropsch wax; oxides of hydrocarbon waxes such as polyethylene oxide wax, and block copolymers thereof; waxes consisting primarily of fatty acid esters such as carnauba wax; and waxes comprising partially or completely deoxidized fatty acid esters such as deoxidized carnauba wax. Some other examples are: saturated linear fatty acids such as palmitic acid, stearic acid and montanoic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyvalent alcohols such as sorbitol; esters of fatty acids such as palmitic acid, stearic acid, behenic acid and montanoic acid with alcohols such as stearyl alcohol, aralkyl alcohol, behenyl alcohol, carnaubyl alcohol, ceryl alcohol and melissyl alcohol; fatty acid amides such as linoleic acid amides, oleic acid amides and lauric acid amides; saturated fatty acid bisamides such as methylene bis-stearamide, ethylene bis-capramide, ethylene bis-lauramide and hexamethylene bis-stearamide; unsaturated fatty acid amides such as ethylene bis-oleamide, hexamethylene bis-oleamide, N,N'-dioleyladipamide and N,N'-dioleylsebacamide; aromatic bisamides such as m-xylene bis-stearamide, and N,N'-distearyl isophthalamide; aliphatic metal salts (generally called metal soaps) such as calcium stearate, calcium laurate, zinc stearate and magnesium stearate; waxes obtained by grafting aliphatic hydrocarbon waxes with vinyl monomers such as styrene or acrylic acid; partial esterification products of fatty acids and polyvalent alcohols such as behenic acid monoglycerides; and hydroxyl-containing methyl ester compounds obtained by hydrogenating plant oils and fats.

Of these waxes, a hydrocarbon wax such as paraffin wax or Fischer-Tropsch wax, or a fatty acid ester wax such as carnauba wax is desirable for improving low-temperature fixability and hot offset resistance. In the present invention, a hydrocarbon wax is more preferred for dispersing the crystalline polyester resin and wax separately and further improving dispersibility.

In the present invention, the wax is preferably used in the amount of 1 to 20 mass parts per 100 mass parts of the amorphous polyester resin.

Moreover, the peak temperature of the maximum endothermic peak of the wax is preferably 45° C. to 140° C. in an endothermic curve obtained with a differential scanning calorimeter (DSC) during temperature rise. The peak temperature of the maximum endothermic peak of the wax is preferably within this range in order to achieve both storability and hot offset resistance of the toner.

(Colorant)

The following are examples of colorants that can be included in the toner.

Examples of black colorants include carbon black and blacks that have been color matched by mixing yellow, magenta and cyan colorants. A pigment may be used alone as a colorant, but considering the image quality of the full color images, it is desirable to improve color definition by combining a dye and a pigment.

The following are examples of pigments for magenta toners: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. pigment violet 19; C.I. vat red 1, 2, 10, 13, 15, 23, 29, 35.

The following are examples of dyes for magenta toners: oil-soluble dyes such as C.I. solvent red 1, 3, 8, 23, 24, 25, 27, 30, 49, 81, 82, 83, 84, 100, 109, 121; C.I. disperse red 9; C.I. solvent violet 8, 13, 14, 21, 27; and C.I. disperse violet 1; basic dyes such as C.I. basic red 1, 2, 9, 12, 13, 14, 15, 17, 18, 22, 23, 24, 27, 29, 32, 34, 35, 36, 37, 38, 39, 40; and C.I. basic violet 1, 3, 7, 10, 14, 15, 21, 25, 26, 27, 28.

The following are examples of cyan toner pigments: C.I. pigment blue 2, 3, 15:2, 15:3, 15:4, 16, 17; C.I. vat blue 6; C.I. acid blue 45; and copper phthalocyanine pigments substituted with 1 to 5 phthalimidomethyl groups in the phthalocyanine backbone.

C.I. solvent blue 70 is a cyan toner dye.

The following are examples of yellow toner pigments: C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185, and C.I. vat yellow 1, 3, 20.

C.I. solvent yellow 162 is a yellow toner dye. The colorant is preferably used in the amount of 0.1 to 30 mass parts per 100 mass parts of the amorphous polyester resin.

(Charge Control Agent)

A charge control agent may be included in the toner as necessary. A known agent may be used as the charge control agent in the toner, but an aromatic carboxylic acid metal compound that is colorless and capable of maintaining a rapid charging speed and a stable charge quantity of the toner is especially desirable.

Examples of negative charge control agents include salicylic acid metal compounds, naphthoic acid metal compounds, dicarboxylic acid metal compounds, polymeric compounds having sulfonic acid or caboxylic acid in the side chains, polymeric compounds having sulfonic acid salts or sulfonic acid esters in the side chains, polymeric compounds having carboxylic acid salts or carboxylic acid esters in the side chains, boron compounds, urea compounds, silicon compounds, and calixarene. Examples of positive charge control agents include quaternary ammonium salts, polymeric compounds having these quaternary ammonium salts in the side chains, guanidine compounds and imidazole compounds. The charge control agent may be added either internally or externally to the toner particles. The added amount of the charge control agent is preferably 0.2 to 10 mass parts per 100 mass parts of the amorphous polyester resin.

(Crystalline Polyester Resin)

The toner of the present invention contains a crystalline polyester resin.

In the toner of the present invention, the crystalline polyester resin contained in the toner particles is preferably obtained by a polycondensation reaction of a monomer composition containing a $C_{2-22}$ aliphatic diol and a $C_{2-22}$ aliphatic dicarboxylic acid as principal components.

A crystalline resin is defined here as a resin that exhibits a clear endothermic peak (melting point) in a reversible specific heat change curve obtained by measuring changes in specific heat with a differential scanning calorimeter.

The $C_{2-22}$ (preferably $C_{4-12}$) aliphatic diol is not particularly limited, but is preferably a chain (more preferably linear) aliphatic diol, and examples include ethylene glycol, diethylene glycol, triethylene glycol, 1,2-propanediol, 1,3-propanediol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol and neopentyl glycol. Of these, particularly desirable examples are linear aliphatic $\alpha,\omega$-diols such as ethylene glycol, diethylene glycol, 1,4-butanediol, and 1,6-hexanediol.

An alcohol selected from the $C_{2-22}$ aliphatic diols preferably constitutes 50 mass % to 100 mass % or more preferably at least 70 mass % of the alcohol component.

A polyvalent alcohol monomer other than the aforementioned aliphatic diol may also be used in the present invention. Of the polyvalent alcohol monomers, examples of bivalent alcohol monomers include aromatic alcohols such as polyoxyethylenated bisphenol A, and polyoxypropylenated bisphenol A; and 1,4-cyclohexane dimethanol and the like. Moreover, of the polyvalent alcohol monomers, examples of trivalent or higher polyvalent alcohol monomers include aromatic alcohols such as 1,3,5-trihydroxymethyl benzene; and aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylol ethane, trimethylol propane and the like.

Moreover, a monovalent alcohol may also be used in the invention to the extent that it does not detract from the properties of the crystalline polyester resin. Examples of this monovalent alcohol include n-butanol, isobutanol, sec-butanol, n-hexanol, n-octanol, lauryl alcohol, 2-ethyl hexanol, decanol, cyclohexanol, benzyl alcohol, dodecyl alcohol and other monofunctional alcohols and the like.

Meanwhile, the $C_{2-22}$ (preferably $C_{6-14}$) aliphatic dicarboxylic acid is not particularly limited, but is preferably a chain (more preferably linear) aliphatic dicarboxylic acid. Specific examples include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid and itaconic acid, as well as acid anhydrides or hydrogenated lower alkyl esters of these.

In the present invention, preferably a carboxylic acid selected from the $C_{2-22}$ aliphatic dicarboxylic acids constitutes 50 mass % to 100 mass % or more preferably at least 70 mass % of this carboxylic acid component.

A polyvalent carboxylic acid other than the aforementioned $C_{2-22}$ aliphatic dicarboxylic acid may also be used in the invention. Of the other polyvalent carboxylic monomers, examples of bivalent carboxylic acids include aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid, as well as acid anhydrides or lower alkyl esters of these. Of the other carboxylic acid monomers, examples of trivalent or higher polyvalent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid and pyromellitic acid, and aliphatic carboxylic acids such as 1,2,4-butanetricarboxylic acid, 1,2,5-hexanetricarboxylic acid and 1, 3-dicarboxyl-2-methyl-2-methylenecarboxypropane, as well as acid anhydrides or lower alkyl esters of these.

Moreover, a monovalent carboxylic acid may also be used in the invention to the extent that it does not detract from the properties of the crystalline polyester resin. Examples of monovalent carboxylic acids include benzoic acid, naphthalenecarboxylic acid, salicilic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, stearic acid and other monocarboxylic acids.

The crystalline polyester resin in the present invention can be manufactured by ordinary polyester synthesis methods. For example, the desired crystalline polyester resin can be obtained by subjecting the carboxylic acid monomer and alcohol monomer to an esterification reaction or transesterification reaction, followed by a polycondensation reaction performed by ordinary methods under reduced pressure or with introduced nitrogen gas.

This esterification or transesterification reaction can be performed as necessary using an ordinary esterification catalyst or transesterification catalyst such as sulfuric acid, titanium butoxide, dibutyl tin oxide, manganese acetate, magnesium acetate or the like.

The polycondensation reaction can be performed using an ordinary polymerization catalyst, such as titanium butoxide, dibutyl tin oxide, tin acetate, zinc acetate, tin disulfide, antimony trioxide or germanium dioxide. The polymerization temperature and amount of the catalyst are not particularly limited, and can be determined appropriately.

In the esterification or transesterification reaction or polycondensation reaction, a method may be used such as loading all the monomers at once in order to increase the strength of the resulting crystalline polyester resin, or reacting the bivalent monomers first and then adding and reacting the trivalent and higher monomers in order to reduce the low-molecular-weight component.

(Inorganic Fine Particles)

Inorganic fine particles may be included as necessary in the toner of the invention. The inorganic fine particles may be added internally to the toner particles as an internal additive, or may be mixed with the toner particles as an external additive.

Using 20 nm to 200 nm of inorganic fine particles as an internal additive helps to confer material dispersibility within the toner during manufacture, and to maintain the dispersed state of the materials during high-temperature storage, aiding the effects of the invention. Silicon oxide (silica), titanium oxide (titania), alumina (aluminum oxide) and strontium titanate particles are desirable as internally-added inorganic fine particles, and silicon oxide particles are especially desirable. The preferred added amount of the internal additive is 0.02 to 3.00 mass parts per 100 mass parts of the amorphous polyester resin.

Inorganic fine particles such as silica, titania and alumina are preferred as external additives. These inorganic fine particles are preferably hydrophobically treated with a hydrophobic agent such as a silane compound, silicone oil or a mixture of these.

Inorganic fine particles with a specific surface area of 50 $m^2/g$ to 400 $m^2/g$ are desirable as external additives for improving flowability, while inorganic fine particles with a specific surface area of 10 $m^2/g$ to 50 $m^2/g$ are desirable for stabilizing durability. Different inorganic fine particles with specific surface areas within these ranges may be combined in order to achieve both improved flowability and stable durability.

The external additive is preferably used in the amount of 0.1 to 10.0 mass parts per 100 mass parts of the toner particles. The toner particles and external additives may be mixed with a known mixing apparatus such as a Henschel mixer.

(Developer)

The toner of the invention can be used as a one-component developer, but a two-component developer obtained by mixing the toner with a magnetic carrier is preferred for improving dot reproducibility, and for obtaining stable images in the long term.

The magnetic carrier may be a commonly known carrier, such as a surface oxidized iron powder or unoxidized iron powder, or metal particles such as iron, lithium, calcium, magnesium, nickel, copper, zinc, cobalt, manganese, chromium, and rare earth, or alloy or oxide particles of these, magnetic body such as a ferrite, or a magnetic body-dispersed resin carrier (so-called resin carrier) containing a magnetic carrier and a binder resin supporting the magnetic carrier in a dispersed state.

Regarding the carrier mixing ratio when the toner of the invention is mixed with a magnetic carrier and used as a two-component developer, good results can normally be obtained if the toner concentration in the two-component developer is 2 mass % to 15 mass %, or preferably 4 mass % to 13 mass %.

(Manufacturing Method)

A preferred method of manufacturing the toner is a pulverization method in which the binder resins and wax are melt kneaded together with a colorant as needed, and the kneaded product is cooled, pulverized and classified.

The toner manufacturing procedures using the pulverization method are explained below.

In the raw material mixing step, the constituent materials of the toner particles, such as an amorphous polyester resin, a crystalline polyester resin and a wax together with a colorant, charge control agent and other components as needed are measured in specified amounts, blended and mixed. Examples of mixing devices include the double cone mixer, V-shaped mixer, drum mixer, super mixer, Henschel mixer, Nauta mixer and Mechano-Hybrid (Nippon Coke & Engineering).

Next the mixed materials are melt kneaded to disperse the wax, crystalline polyester resin and the like in the amorphous polyester resin. The kneading and discharge temperature is preferably 100° C. to 170° C. The rotation speed during kneading is preferably about 250 to 450 rpm. A pressure kneader, Banbury mixer or other batch kneader or a continuous kneader may be used in the melt kneading step, but uniaxial or biaxial extruders are chiefly used because they are advantageous for continuous production. Examples include a KTK biaxial extruder available from Kobe Steel, Ltd., a TEM biaxial extruder available from Toshiba Machine Co., Ltd., a PCM kneader available from Ikegai Ironworks Corp., a biaxial extruder available from K.C.K. Co., a co-kneader available from Buss Corp., and a Kneadex available from Nippon Coke & Engineering. The resin composition obtained by melt kneading can then be rolled with a double roll or the like, and cooled with water or the like in a cooling step. The cooling speed is preferably 1 to 50° C./min.

Next, the cooled resin composition is pulverized to the desired particle size in a pulverization step. The pulverization step may comprise coarse pulverization with a crusher, hammer mill, feather mill or other crushing apparatus for example, followed by further fine pulverization with a pulverizing apparatus such as a Kryptron pulverizer available from Kawasaki Heavy Industries Ltd., a Super Rotor available from Nisshin Engineering Inc., a Turbo Mill available from Turbo Kogyo Co., Ltd., or a finely pulverizing apparatus by an air jet system for example.

This is then classified as necessary with a sieving machine or classifier such as an Elbow Jet (Nittetsu Mining Co., Ltd.) using inertial classification, a Turboplex (Hosokawa Micron Corporation) using centrifugal classification, a TSP separator (Hosokawa Micron Corporation), a Faculty (Hosokawa Micron Corporation) or the like.

Next, inorganic fine particles, resin particles or other external additives that have been selected as necessary may be added and mixed (external addition). For example, an external additive may be added to confer flowability and obtain pre-heat-treatment toner particles.

Mixing can be performed with a mixing apparatus having a rotating member equipped with an agitator and also having a main casing separated by a gap from the agitator. Examples of such mixing apparatuses include a Henschel Mixer (Mitsui Mining Co., Ltd.), Super Mixer (Kawata Mfg Co., Ltd.), Ribocone (Okawara Mfg. Co., Ltd.), Nauta Mixer, Turbulizer, Cyclomix (Hosokawa Micron Corporation), Spiral Pin Mixer (Pacific Machinery & Engineering Co., Ltd.), Lodige Mixer (Matsubo Corporation) and Nobilta (Hosokawa Micron Corporation). A Henschel Mixer (Mitsui Mining Co., Ltd.) is particularly desirable for achieving uniform mixing and breaking up silica aggregates.

The machine conditions for mixing include treated amount, agitator shaft rotations, agitation time, agitator blade shape, tank temperature and the like, which can be selected appropriately considering the properties of the toner particles and the types of additives, without any particular limitations, in order to achieve the desired toner properties.

Heat or mechanical load may also be applied to the toner particles obtained by this manufacturing method or the like to increase the hydrophobicity of the toner particle surfaces or modify the particles by surface profile smoothing.

Figure 3:
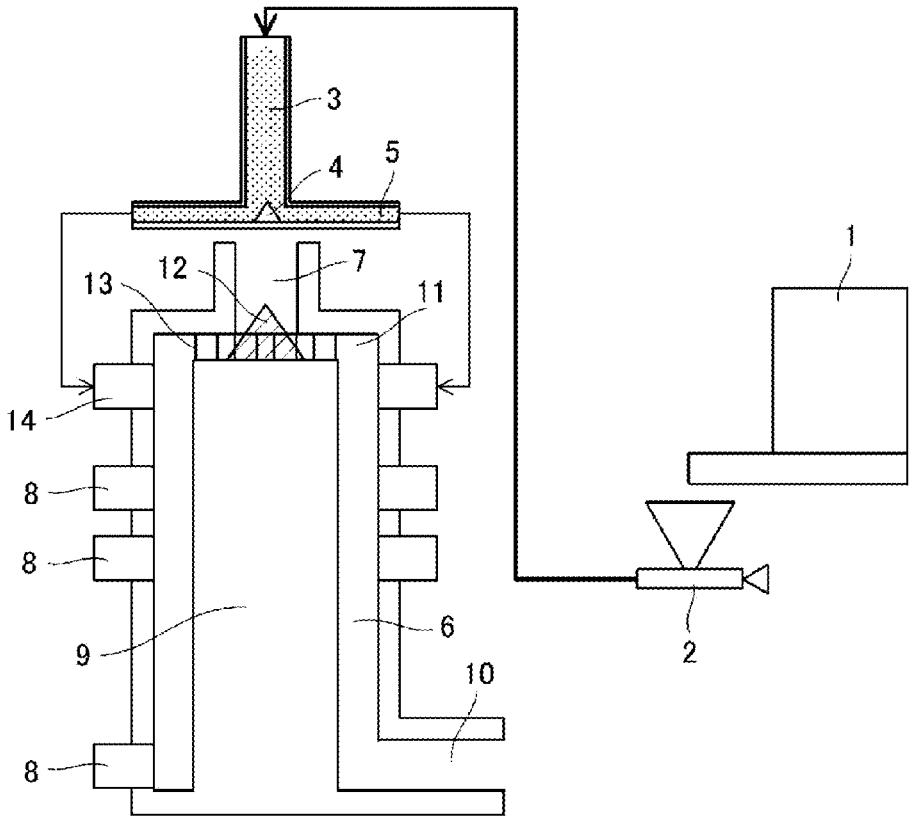
FIG. 3 is a cross-section of a surface treatment apparatus that can be used with the toner of the present invention.

As a surface modification step, surface treatment may be performed with a hot air current using the surface treatment apparatus shown in FIG. 3 for example.

A mixture is volumetrically supplied by raw material volumetric feed means 1, and conducted by a compressed gas regulated by compressed gas regulation means 2 to introduction pipe 3, which is disposed on the same vertical line as the raw material feed means. After passing through the introduction pipe, the mixture is uniformly dispersed by conical projecting member 4 disposed in the center of the raw material feed means. It is then conducted to feed pipes 5 extending radially in 8 directions, and conducted to treatment chamber 6 for heat treatment.

The flow of the mixture supplied to the treatment chamber is regulated by a regulation means 9 for regulating the flow of the mixture within the treatment chamber. Therefore, the mixture supplied to the treatment chamber is heat treated and cooled while circulating in the treatment chamber.

The heat for heat-treating the supplied mixture is supplied by a hot air supply means 7 and distributed by a distribution member 12, and a circulation member 13 for circulating the hot air current introduces the hot air current into the treatment chamber while circulating it spirally. In this configuration, the circulation member 13 for circulating the hot air current may have multiple blades so that the circulation of the hot air current is controlled by means of the number and angles of the blades. Regarding the hot air current supplied inside the treatment chamber, the temperature at the outlet of the hot air supply means 7 is preferably at or above the melting point of the crystals of the crystalline polyester resin, and 20° C. to 70° C. higher than the softening point Tm of the toner particles. For example, 120° C. to 170° C. is desirable. If the temperature at the outlet of the hot air supply means is within this range, it is possible to prevent melt adhesion and coalescing of the toner particles due to overheating of the mixture while performing surface modification treatment uniformly and only on the surfaces of the toner particles. The hot air current is supplied from the hot air supply means outlet 11. The temperature of the hot air current is preferably at least 40° C. (preferably 42° C. to 75° C.) higher than the melting point of the wax so that the wax near the toner surface layer in the toner of the invention will spread thinly on the toner surface, making the toner surface more hydrophobic and preventing toner aggregation in high-humidity environments.

The heat treated toner particles are then cooled by a cool air current supplied by cool air supply means 8, with the temperature of the air supplied by the cool air supply means 8 being preferably −40° C. to 20° C. If the temperature of the cool air current is within this range, the heat-treated toner particles can be cooled efficiently, and melt adhesion and coalescing of the heat-treated toner particles can be prevented as crystalline polyester that has been blended in the surface layer of the toner particles is precipitated as very fine crystals. The absolute moisture content of the cool air current is preferably 0.5 g/m$^3$ to 15.0 g/m$^3$. The cool air current volume is preferably 1 to 30 m$^3$/min.

Next, the cooled heat-treated toner particles are collected by collection means 10 at the bottom of the treatment chamber. A blower (not shown) is provided at the end of the collection means to transport the particles by suction.

Powder particle feeding port 14 is provided in such a way that the circulating direction of the supplied mixture is the same as the circulating direction of the hot air current, and collection means 10 of the surface treatment unit is provided on the outer circumference of the treatment chamber so as to maintain the circulating direction of the circulating powder particles. Moreover, the device is configured so that the cool air current supplied by the cool air supply means 8 is supplied horizontally and tangentially from the outer circumference of the apparatus to the inner periphery of the treatment chamber. The circulating direction of the pre-heat-treatment toner particles supplied from the powder feeding port, the circulating direction of the cool air current supplied from the cool air supply means and the circulating direction of the hot air current supplied from the hot air supply means are all the same direction. This means that no turbulence occurs within the treatment chamber, reinforcing the circulating flow within the device so that the pre-heat-treatment toner particles are subject to strong centrifugal force, thus further improving the dispersibility of the pre-heat-treatment toner particles and resulting in heat-treated toner particles containing few coalesced particles.

Moreover, externally adding and mixing fine particles in advance in the toner particles to confer flowability before introducing the toner into the heat-treatment apparatus also serves to improve the dispersibility of the toner in the apparatus, reducing coalesced particles and controlling variation in surface modification among the particles.

Selected inorganic fine particles, resin particles or other external additives can then be added and mixed (external addition) as necessary to confer flowability or improve charge stability for example and produce the toner. Mixing can be performed with a mixing apparatus having a rotating member equipped with an agitator and also having a main casing separated by a gap from the agitator.

Examples of such mixing apparatuses include the Henschel Mixer (Mitsui Mining Co., Ltd.), Super Mixer (Kawata Mfg Co., Ltd.), Ribocone (Okawara Mfg. Co., Ltd.), Nauta Mixer, Turbulizer, Cyclomix (Hosokawa Micron Corporation), Spiral Pin Mixer (Pacific Machinery & Engineering Co., Ltd.), Lodige Mixer (Matsubo Corporation) and Nobilta (Hosokawa Micron Corporation). A Henschel Mixer (Mitsui Mining Co., Ltd.) is particularly desirable for achieving uniform mixing and breaking up silica aggregates.

The machine conditions for mixing include treated amount, agitator shaft rotations, agitation time, agitator blade shape, tank temperature and the like, which can be selected appropriately considering the properties of the toner particles and the types of additives, without any particular limitations, in order to achieve the desired toner properties.

A sieving machine or the like may also be used as necessary in cases in which coarse aggregates of an additive for example are freely present in the resulting toner.

The various physical properties of the toner and raw materials and the measurement methods are explained below.

(Evaluation of Toner Cross-Section by TEM)

The crystalline polyester resin and wax domains were evaluated as follows by cross-sectional observation of the toner by transmission electron microscopy (TEM).

A toner cross-section was dyed with ruthenium to obtain a clear contrast of the crystalline polyester resin. Because the strength or weakness of the dye reflects differences in the amount of ruthenium atoms, the strongly dyed parts indicate areas with more of these atoms, and appear black in the image because the electron beam does not pass through, while the weakly dyed parts appear white because the electron beam passes through easily. The crystalline polyester resin is dyed more weakly than the organic component constituting the toner interior. It is thought that this is because penetration of the dye material in the crystalline polyester resin is weaker than in the organic component inside the toner due to differences in density and the like. The ruthenium dye that fails to penetrate the interior of the crystalline polyester resin is likely to remain at the boundaries between the crystalline polyester resin and the amorphous polyester resin, and when the crystals are needle-shaped the crystalline polyester resin appears black as a result. Because penetration of the ruthenium dye is even more inhibited in the wax, it appears the most white.

Using an Osmium Plasma Coater (Filgen, Inc., OPC80T), the toner was provided with an Os film (5 nm) and a naphthalene film (20 nm) as protective films, and embedded in D800 photocurable resin (JEOL Ltd.), after which a toner cross-section 60 nm (or 70 nm) thick was prepared with an ultrasonic Ultramicrotome (Leica Microsystems, UC7) at a cutting speed of 1 mm/s.

The resulting cross-section was dyed for 15 minutes in a $RuO_4$ gas 500 Pa atmosphere with a vacuum electron staining apparatus (Filgen, Inc., VSC4R1H), and observed by STEM observation using a TEM (JEOL Ltd., JEM2800) with a STEM probe size of 1 nm and an image size of 1024×1024 pixels.

The resulting image was binarized (threshold 120/255 stages) with image processing software (Media Cybernetics, Inc. "Image-Pro Plus").

The resulting cross-sectional image before binarization is shown in FIG. 1. As shown in FIG. 1, the crystal domains of the crystalline polyester resin can be confirmed as black needle shapes, and by binarizing the resulting image, it was possible to extract the crystalline domains and measure their size. With a binarization threshold of 210, the parts that appeared white were assumed to be wax, and their size was measured.

All of the wax diameters and all of the major axis lengths of the measurable crystal domains of the crystalline polyester resin were measured in a cross-sectional observation of 20 toner particles selected randomly from toner particles with a diameter within ±25% of the weight-average particle size (D4) of the toner particles of the invention. However, the wax domains on the outermost surface of the toner were not counted.

Figure 2:
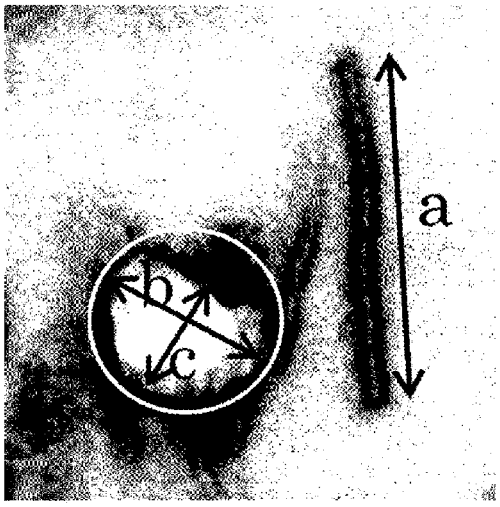
FIG. 2 shows the major axis length of the crystalline polyester and the length of the wax in a toner cross-section.

As shown in FIG. 2, the major axis length of a crystal domain of the crystalline polyester resin is the maximum distance (a in FIG. 2) in the crystal domain in the cross-sectional image. The minor axis length is the smallest distance at the midpoint of the major crystal axis, and the aspect ratio of the crystalline polyester crystals is determined by dividing the major axes lengths by the minor axes lengths, and calculating the average.

"Needle-shaped" in the present invention indicates a long, thin and very straight shape, and means that given a minor axis length of 40 nm or less and an aspect ratio (major axis/minor axis) of 3 or more, when a straight line is drawn between the centers in the minor axial direction at both ends of the crystal in the major axial direction, the deviation in the crystal outline from this straight line is within 100% of the minor axis of the crystal.

A wax domain shape with a number-average aspect ratio of 3 or less is preferred for controlling uneven distribution due to aggregation of crystals of the crystalline polyester resin.

The diameter of a wax domain is the wax diameter obtained by measuring the major axis b and minor axis c shown in FIG. 2, adding them and dividing the sum by 2.

The number-averages of the measured wax diameters and major axis lengths of the crystalline polyester resin are determined and called Dw and Dc. The total areas of the crystalline polyester resin crystals and wax domains are measured with the image processing software by binarizing the images as described above, and the area ratios in the toner cross-section area are determined.

The area ratios are calculated as follows.

To determine the area of the crystals of the crystalline polyester resin, the pixels in a cross-section of the crystals of the crystalline polyester resin were counted with the image processing software, and the total area contained in one toner particle was given in pixels.

To determine the area of the wax domains, the pixels in a cross-section of the wax domains were counted with the image processing software, and the total area contained in one toner particle was given in pixels. (However, the wax domains on the outermost toner surface were not counted).

The number of pixels in the cross-sectional area of one toner particle was similarly counted, and the pixels of the crystals of the crystalline polyester resins and the pixels of the wax domains were divided by the number of pixels in the toner cross-section and then multiplied by 100 to determine the respective area ratios of each cross-sectional area relative to one toner particle. This was performed for 20 of the toner particles observed in cross-section, and the average given as the area ratio of each cross-section in the toner cross-section.

In the present invention, the area occupied by wax domains is 0.5% to 8.0% of the cross-sectional area of the toner, and the area occupied by the crystals of the crystalline polyester resin is 0.5% to 8.0%. When the areas occupied by the wax domains and the crystals of the crystalline polyester resin are each 0.5% or more of the cross-sectional area of the toner, low-temperature fixability and fixing separability can be achieved during fixing. When the areas occupied by the wax domains and the crystals of the crystalline polyester resin are each 8.0% or less of the cross-sectional area of the toner, the charge quantity of the toner due to triboelectric charging is likely to be within the useful range. The areas occupied by the wax domains and the crystals of the crystalline polyester resin are preferably 2.0% to 7.0%.

The area occupied by the wax domains can be controlled by controlling the added amount of the wax.

The area occupied by the domains of the crystal polyester resin can be controlled by controlling the added amount of the crystalline polyester resin and the polarity difference (compatibility) between the crystalline polyester and the amorphous resin.

No colorant is contained in the interior of the crystals of the crystalline polyester. Therefore, from the standpoint of toner tinting strength, a number-average diameter Dc of 280 nm or less (preferably 250 nm or less) of the major axis lengths of the crystalline polyester resin crystals is desirable for preventing uneven distribution of the colorant in the toner binder resin. A Dc of 30 nm or more is also desirable.

The number-average diameter Dc of the major axis lengths of the crystalline polyester resin crystals can be controlled by controlling the polarity difference (compatibility) between the crystalline polyester and the amorphous resin and the cooling temperature (cooling speed) after melt kneading of the toner particles.

Moreover, for purposes of preventing the phenomenon of gradual aggregation of the wax domains inside the toner during long-term storage of the toner at high temperatures, it is desirable that the standard deviation of the number-average diameter Dc of the crystalline polyester resin be 100 nm or less (more preferably 90 nm or less), and that the standard deviation of the number-average diameter Dw of the wax also be 100 nm or less (more preferably 90 nm or less). It is thus possible to prevent large wax domains from bleeding out of the toner and contaminating the developing apparatus when toner that has been left in such a storage environment is subjected to mechanical load in the developing apparatus.

The standard deviation of the number-average diameter is calculated as follows.

The number-average diameter data calculated from TEM observation and the image processing software are input into Excel (Microsoft Corporation) spreadsheet software, and the standard deviation values are calculated using the STDEVP function for statistical calculation.

In the present invention, the number-average diameter Dw of the wax domains is 60 nm to 240 nm, or preferably 80 nm to 200 nm. If Dw is within this range, seepage of the wax to the toner surface during toner fixing is likely to be rapid and uniform, and it is possible to control contamination of the fixing member during low-temperature fixing. The number-average diameter of the wax domains can be controlled by controlling the kneading rotations and kneading temperature during melt kneading of the toner materials, as well as the kind of wax (resin and polarity difference).

The crystalline polyester crystals are preferably needle-shaped in the present invention. The aspect ratio of the crystalline polyester crystals is 5.0 to 25.0, or preferably 6.0 to 16.0. With an aspect ratio within this range, seepage of the wax to the toner surface during toner fixing is likely to be rapid and uniform, and it is possible to control contamination of the fixing member during low-temperature fixing. The aspect ratio can be controlled by controlling the cooling temperature (cooling speed) of the toner materials after melt kneading, and the polarity difference (compatibility) between the crystalline polyester resin and the amorphous polyester resin.

(Method of Measuring Weight-Average Molecular Weight of Resin)

The molecular weight distribution of the THF soluble matter of the resin is measured as follows by gel permeation chromatography (GPC).

First, the toner is dissolved in tetrahydrofuran (THF) over 24 hours at room temperature. The resulting solution is then filtered with a solvent-resistant membrane filter ("Pretreatment Disk", Tosoh Corporation) with a pore diameter of 0.2 μm to obtain a sample solution. The sample solution is adjusted to a concentration of about 0.8 mass % of the THF-soluble components. Measurement is then performed under the following conditions using the sample solution.

Apparatus: HLC8120 GPC (detector: RI) (Tosoh Corporation)

Columns: Series of 7: Shodex KF-801, 802, 803, 804, 805, 806, 807 (Showa Denko K.K.)

Eluent: Tetrahydrofuran (THF)

Flow rate: 1.0 ml/min

Oven temperature: 40.0° C.

Injected amount of sample: 0.10 ml

A molecular weight calibration curve prepared using standard polystyrene resin (for example, TSK Standard Polystyrene™ F-850, F-450, F-288, F-128, F-80, F-40, F-20, F-10, F-4, F-2, F-1, A-5000, A-2500, A-1000, A-500, Tosoh Corporation) is used for calculating the molecular weight of the sample.

(Measuring Melting Point of Wax)

The melting point of the wax in the toner of the invention is measured under the following conditions using a DSC Q1000 differential scanning calorimeter (TA Instruments.).

Ramp rate: 10° C./min

Initial measurement temperature: 20° C.

Final measurement temperature: 180° C.

The melting points of indium and zinc are used for correcting the detection part of the unit, while the heat of fusion of indium is used to correct the heat quantity.

Specifically, 5 mg of sample is weighed exactly, placed in a silver pan, and measured once. An empty silver pan is used as a reference.

The melting point of the wax is determined from the endothermic start point of the wax endotherm in a DSC curve measured under the above conditions.

(Measurement of BET Specific Surface Area of Inorganic Fine Particles)

The BET specific surface area of the inorganic fine particles is measured according to JIS 28830 (2001). The specific measurement methods are as follows.

A Tristar 3000 (Shimadzu Corporation) automated surface area and porosity analyzer employing a constant-volume gas adsorption measurement system is used as the measurement apparatus. Measurement conditions are set and measurement data are analyzed using the accessory dedicated software "TriStar 3000 Version 4.00"), and a vacuum pump, nitrogen gas line and helium gas line are attached to the apparatus. Nitrogen gas is used as the adsorption gas, and a value calculated by the BET multipoint method is given as the BET specific surface area of the inorganic fine particles in the present invention.

The BET specific surface area is calculated as follows.

First, nitrogen gas is adsorbed by the inorganic fine particles, and at this time the balance pressure P (Pa) within the sample cell and the nitrogen adsorption Va (moles·$g^{-1}$) of the external additive are measured. The balance pressure P (Pa) within the sample cell is then divided by the saturated vapor pressure Po (Pa) of nitrogen to obtain a relative pressure value Pr that is plotted on the horizontal axis, while the nitrogen adsorption Va (moles·$g^{-1}$) is plotted on the vertical axis to obtain an adsorption isotherm. Next, the monolayer adsorption Vm (moles·$g^{-1}$), which is the adsorbed amount necessary for forming a monolayer on the surface of the external additive, is determined by the following BET formula:

$$Pr/Va(1-Pr)=1/(Vm\times C)+(C-1)\times Pr/(Vm\times C)$$

(wherein C is the BET parameter, a variable that changes according to the type of measurement sample, type of adsorbed gas and adsorption temperature).

The BET formula can be understood in terms of a straight line (called the BET plot) having Pr plotted on the X axis and Pr/Va (1−Pr) on the Y axis, with a slope of (C−1)/(Vm×C) and an intercept of 1/(Vm×C).

$$\text{Slope of line}=(C-1)/(Vm\times C)$$

$$\text{Line intercept}=1/(Vm\times C)$$

With the actual measured values of Pr and Pr/Va (1−Pr) plotted on a graph, a straight line can be drawn by the least square method, and the slope and intercept values of that line can be calculated. Vm and C can then be calculated by using these values to solve a simultaneous equation for the slope and intercept.

The BET specific surface area S ($m^2/g$) of the inorganic fine particles is also calculated based on the following formula from the calculated Vm and the molecular cross-section area (0.162 $nm^2$) of a nitrogen molecule.

$$S=Vm\times N\times 0.162\times 10^{-18}$$

(where N is Avogadro's number ($mole^{-1}$)).

Measurement with this apparatus is performed according to the accessory "TriStar 3000 Manual V. 4.0", and specifically the measurement procedures are as follows.

The tare of a thoroughly washed and dried dedicated glass sample cell (stem diameter ⅜", capacity about 5 ml) is weighed exactly. About 0.1 g of the external additive is then supplied to this sample cell with a funnel.

The sample cell containing the inorganic fine particles is then set in a VacuPrep 061 (Shimadzu Corporation) pretreatment apparatus connected to a vacuum pump and a nitrogen gas line, and vacuum degassed continuously for about 10 hours at 23° C. Vacuum degassing is performed gradually with the valve adjusted so that inorganic fine particles are not sucked up by the vacuum pump. The pressure in the cell falls gradually as degassing progresses, finally becoming about 0.4 Pa (about 3 millitorrs). After completion of vacuum degassing, nitrogen gas is gradually injected to restore atmospheric pressure inside the sample cell, which is then removed from the pretreatment apparatus. The mass of this sample cell is then weighed exactly, and the accurate mass of the external additive is calculated from the difference between this and the tare. The sample cell is covered with a rubber stopper during the weighing process so that the external additive in the sample cell is not contaminated by moisture or the like from the atmosphere.

Next, a dedicated "isothermal jacket" is attached to the stem of the sample cell containing the inorganic fine particles. A dedicated filler rod is then inserted into this sample cell, and the sample cell is set in the analysis port of the apparatus. An "isothermal jacket" is a tubular member capable of soaking up liquid nitrogen by capillary action up to a certain level, and is configured with a porous material on the inner wall and an impermeable material on the outer wall.

Next, the free space in the sample cell including attachments is measured. The free space is calculated from the difference between the volume of the sample cell as measured with helium gas at 23° C. and the volume of the sample cell measured similarly with helium gas after the cell has been cooled with liquid nitrogen. The saturated vapor pressure Po (Pa) of the nitrogen is measured separately and automatically using the built-in Po tube of the apparatus.

Next, the inside of the sample cell is vacuum degassed, and vacuum degassing is continued as the cell is cooled with liquid nitrogen. Next, nitrogen gas is introduced in stages into the sample cell to adsorb the nitrogen molecules in the inorganic fine particles. An adsorption isotherm can be obtained during this process by measuring the balance pressure P (Pa) at any times, and this adsorption isotherm is converted into the BET plot. A total of 6 relative pressure Pr points are set for collecting data: 0.05, 0.10, 0.15, 0.20, 0.25 and 0.30. A straight line is created by the least square method from the resulting measurement data, and Vm is calculated from the slope and intercept of this line. This Vm value is then used to calculate the BET specific surface area of the inorganic fine particles as discussed above.

(Method of Measuring Weight-Average Particle Diameter (D4) of Toner Particles)

Using a Multisizer® 3 Coulter Counter precise particle size distribution analyzer (Beckman Coulter, Inc.) based on the pore electrical resistance method with a 100 μm aperture tube together with the accessory dedicated Beckman Coulter Multisizer 3 Version 3.51 software (Beckman Coulter, Inc.) for setting measurement conditions and analyzing measurement data, the particles are measured with 25,000 effective measurement channels and the measurement data are analyzed to calculate the weight-average particle diameter (D4) of the toner particles.

The aqueous electrolyte solution used in measurement may be a solution of special grade sodium chloride dissolved in ion exchange water to a concentration of about 1 mass %, such as ISOTON II (Beckman Coulter, Inc.) for example.

The dedicated software settings are performed as follows prior to measurement and analysis.

On the "Standard measurement method (SOM) changes" screen of the dedicated software, the total count number in control mode is set to 50000 particles, the number of measurements to 1, and the Kd value to a value obtained with "standard particles 10.0 μm" (Beckman Coulter, Inc.). The threshold noise level is set automatically by pushing the "Threshold/Noise Level measurement button". The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) About 200 ml of the aqueous electrolyte solution is added to a specialized 250 ml round-bottomed beaker for the Multisizer 3, the beaker is set on the sample stand, and stirring is performed with a stirrer rod counter-clockwise at a rate of 24 rotations/second. Contamination and bubbles in the aperture tube are then removed by the "Aperture flush" function of the dedicated software.

(2) 30 ml of the same aqueous electrolyte solution is placed in a glass 100 ml flat-bottomed beaker, and about 0.3 ml of a dilution of "Contaminon N" (a. 10% by mass aqueous solution of a neutral detergent for washing precision. measuring devices, formed. from a. nonionic surfactant, an anionic surfactant, and an organic builder and having a pH of 7, manufactured by Wako Pure Chemical Industries, Ltd.) diluted 3× by mass with ion. exchange water is added.

(3) A. specific amount of ion exchange water is placed in the water tank of an ultrasonic disperser (Ultrasonic Dispersion System Tetora 150, Nikkaki Bios Co., Ltd.) with an electrical output of 120 W equipped with two built-in oscillators having an oscillating frequency of 50 kHz with their phases shifted by 1.80° from each other, and about 2 ml of the Contaminon N is added to this water tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolyte solution in the beaker.

(5) As the aqueous electrolyte solution in the beaker of (4) is exposed to ultrasound, about 10 mg of toner is added bit by bit to the aqueous electrolyte solution, and dispersed. Ultrasound dispersion is then continued for a further 60 seconds. During ultrasound dispersion, the water temperature in the tank is adjusted appropriately to 10° C. to 40° C.

(6) The aqueous electrolyte solution of (5) with the toner dispersed therein. is dripped with a pipette into the round-bottomed beaker of (1) set on the sample stand, and adjusted to a measurement concentration of about 5%. Measurement is then performed until the number of measured particles reaches 50000.

(7) The measurement data is analyzed. with the dedicated software attached to the apparatus, and the weight-average particle diameter (D4) is calculated. The "Average diameter" on the "Analysis/volume statistical value (arithmetic mean)" screen when Graph/volume % is set in the dedicated software corresponds to the weight-average particle diameter (D4).

EXAMPLES

Amorphous Polyester Resin A1 Manufacturing Example

Polyoxypropylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was then substituted inside the flask, the temperature was raised gradually with agitation, and a reaction was performed for 4 hours at 200° C. with agitation.

The pressure inside the reaction tank was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction tank was reduced to 8.3 kPa, and a reaction was performed for one hour with the temperature maintained at 180° C. (second reaction step) to obtain an amorphous polyester resin A1 with a weight-average molecular weight (Mw) of 5000.

Amorphous Polyester Resin A2 Manufacturing Example

Polyoxyethylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was then substituted inside the flask, the temperature was raised gradually with agitation, and a reaction was performed for 4 hours at 200° C. with agitation.

The pressure inside the reaction tank was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction tank was reduced to 8.3 kPa, and a reaction was performed for one hour with the temperature maintained at 180° C. (second reaction step) to obtain an amorphous polyester resin A2 with a weight-average molecular weight (Mw) of 4800.

Amorphous Polyester Resin A3 Manufacturing Example

Polyoxybutylene(2.2)-2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 4 hours at 200° C. with agitation.

The pressure inside the reaction tank was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction tank was reduced to 8.3 kPa, and a reaction was performed for one hour with the temperature maintained at 180° C. (second reaction step) to obtain an amorphous polyester resin A3 with a weight-average molecular weight (Mw) of 5300.

Amorphous Polyester Resin A4 Manufacturing Example 2,2-bis(4-hydroxyphenyl)propane: 71.9 mass parts (0.20 moles; 100.0 mol % of total moles of polyvalent alcohol)

Terephthalic acid: 26.8 mass parts (0.16 moles; 96.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 4 hours at 200° C. with agitation.

The pressure inside the reaction tank was lowered to 8.3 kPa, maintained for one hour, and then returned to atmospheric pressure (first reaction step).

Anhydrous trimellitic acid: 1.3 mass parts (0.01 moles; 4.0 mol % of total moles of polyvalent carboxylic acid)

This material was then added, the pressure inside the reaction tank was reduced to 8.3 kPa, and a reaction was performed for one hour with the temperature maintained at 180° C. (second reaction step) to obtain an amorphous polyester resin A4 with a weight-average molecular weight (Mw) of 4900.

Amorphous Polyester Resin A5 Manufacturing Example 100 g of a bisphenol A propylene oxide adduct as an manufacturing alcohol component and 100 g of terephthalic acid as an acid component of the polyester A were prepared, and reacted under conditions of 200° C., 6 hours in a flask equipped with a nitrogen introduction tube and a dewatering tube. The atmospheric pressure was changed to 8 kPa, the mixture was reacted for an additional hour, and the resulting reaction product was taken as amorphous polyester resin A5. The measured value of the glass transition temperature Tg (° C.) of the amorphous polyester resin A5 was 58° C.

Amorphous Polyester Resin B1 Manufacturing Example

Polyoxypropylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain an amorphous polyester resin B1 with a weight-average molecular weight (Mw) of 100000.

Amorphous Polyester Resin B2 Manufacturing Example

Polyoxyethylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain an amorphous polyester resin B2 with a weight-average molecular weight (Mw) of 110000.

Amorphous Polyester Resin B3 Manufacturing Example

Polyoxybutylene(2.2)-2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain an amorphous polyester resin B3 with a weight-average molecular weight (Mw) of 120000.

Amorphous Polyester Resin B4 Manufacturing Example 2,2-bis(4-hydroxyphenyl)propane: 71.8 mass parts (0.20 moles; 100.0 mol % of total moles of polyvalent alcohol)

Terephthalic acid: 15.0 mass parts (0.09 moles; 55.0 mol % of total moles of polyvalent carboxylic acid)

Adipic acid: 6.0 mass parts (0.04 moles; 25.0 mol % of total moles of polyvalent carboxylic acid)

Titanium tetrabutoxide: 0.5 mass parts

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 2 hours at 200° C. with agitation.

The pressure inside the reaction tank was lowered to 8.3 kPa, maintained for one hour, and then returned to atmospheric pressure (first reaction step).

Anhydrous trimellitic acid: 6.4 mass parts (0.03 moles; 20.0 mol % of total moles of polyvalent carboxylic acid)

This material was then added, the pressure inside the reaction tank was reduced to 8.3 kPa, and a reaction was performed for 15 hours with the temperature maintained at 160° C. (second reaction step) to obtain an amorphous polyester resin B4 with a weight-average molecular weight (Mw) of 110000.

Crystalline Polyester Resin C1 Manufacturing Example 1,6-hexanediol: 34.5 mass parts (0.29 moles; 100.0 mol % of total moles of polyvalent alcohol)

Dodecanedioic acid: 65.5 mass parts (0.28 moles; 100.0 mol % of total moles of polyvalent carboxylic acid)

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 3 hours at 140° C. with agitation.

Tin 2-ethylhexanoate: 0.5 mass parts

This material was then added, the pressure inside the reaction tank was reduced to 8.3 kPa, and a reaction was performed for 4 hours with the temperature maintained at 200° C. to obtain a crystalline polyester resin C1. The resulting crystalline polyester resin C1 had a clear endothermic peak.

Crystalline Polyester Resin C2 Manufacturing Example 1,4-butanediol: 27.4 mass parts (0.29 moles, 100.0 mol % of total moles of polyvalent alcohol)

Tetradecanedioic acid: 72.6 mass parts (0.28 moles: 100.0 mol % of total moles of polyvalent carboxylic acid)

These materials were measured into a reaction tank equipped with a cooling tube, an agitator, a nitrogen introduction tube and a thermocouple. Nitrogen gas was substituted inside the flask, the temperature was raised gradually with agitation, and a reaction was performed for 3 hours at 140° C. with agitation.

Tin 2-ethylhexanoate: 0.5 mass parts

This material was then added, the pressure inside the reaction tank was reduced to 8.3 kPa, and a reaction was performed for 4 hours with the temperature maintained at 200° C. to obtain a crystalline polyester resin C2. The resulting crystalline polyester resin C2 had a clear endothermic peak.

Vinyl Resin Polymer D Manufacturing Example

| | |
|---|---|
| Polyethylene having 1 or more unsaturated bonds (Mw: 1400, Mn: 850, DSC endothermic peak: 100° C. | 20 mass parts |
| Styrene | 59 mass parts |
| n-butyl acrylate | 18.5 mass parts |
| Acrylonitrile | 2.5 mass parts |

These raw materials were loaded into an autoclave, nitrogen was substituted inside the system, and the mixture was maintained at 180° C. with warming and agitation. 50 mass parts of a 2 mass % xylene solution of di-tert-butylperoxide were dripped in continuously for 5 hours, and after cooling the solvent was separated and removed to obtain a vinyl resin polymer D comprising a copolymer grafted to polyethylene. The resulting vinyl resin polymer D had a softening point of 110° C. and a glass transition temperature of 64° C., and the molecular weights of the polymer D according to GPC of the THF soluble matter were 7400 weight-average molecular weight (Mw) and 2800 number-average molecular weight (Mn). A peak corresponding to the polyethylene having one or more unsaturated bonds of the raw materials was not confirmed.

Toner Manufacturing Example 1

| | |
|---|---|
| Amorphous polyester resin A1 | 70 mass parts |
| Amorphous polyester resin B1 | 30 mass parts |
| Crystalline polyester resin C1 | 7.5 mass parts |
| Vinyl resin polymer D | 5 mass parts |
| Hydrocarbon wax (maximum endothermic peak temperature 90° C.) | 5 mass parts |
| C.I. pigment blue 15:3 | 5 mass parts |
| 3,5-di-t-butylsalicylic acid aluminum compound | 0.5 mass parts |
| Silica fine particles (primary average particle diameter 100 nm) | 1 mass part |
| Titania fine particles (primary average particle diameter 30 nm) | 0.1 mass parts |

The raw materials of this formulation were mixed in a Henschel mixer (FM-75, Mitsui Mining Co., Ltd.) at 1200 rpm for a rotation time of 5 minutes, and then with the temperature set to obtain a discharge temperature of 135° C., they were kneaded in a twin-screw extruder (PCM-30, Ikegai Ironworks Corp.) set to a rotation speed of 350 rpm. The resulting kneaded product was cooled at a cooling speed of 20° C./min, and coarsely pulverized in a hammer mill to 1 mm or less. The resulting coarsely pulverized product was finely pulverized in a mechanical pulverizer (T-250, Turbo Kogyo Co., Ltd.). This was then classified using a rotary classifier (200TSP, Hosokawa Micron Corporation) to obtain toner particles. For the operating conditions of the rotary classifier (200TSP, Hosokawa Micron Corporation), the classifying rotor rotation speed was 3000 rpm. The resulting toner particles had a weight-average particle diameter (D4) of 5.7 μm.

0.5 mass parts of silica fine particles with a primary average particle diameter of 110 nm were added to 100 mass parts of the resulting toner particles, and mixed for a rotation time of 10 minutes at a rotation speed of 1800 $s^{-1}$ in a Henschel mixer (FM-75, Mitsui Mining Co., Ltd.). Heat treatment was performed on the resulting mixture with the surface treatment apparatus shown in FIG. 3 to obtain heat-treated toner particles. The operating conditions were feed=5 kg/hr, hot air current temperature=135° C., hot air current flow rate=6 $m^3$/min, cool air temperature=0° C., cool air current flow rate=4 $m^3$/min, cool air current absolute moisture content=3 g/$m^3$, blower air volume=20 $m^3$/min, injection air flow=1 $m^3$/min. The weight-average particle diameter (D4) of the resulting heat-treated toner particles was 6.2 μm.

1.0 mass parts of silica fine particles with a primary average particle diameter of 13.0 nm were added to 100 mass parts of the resulting heat-treated toner particles, which were then mixed for 5 min in a Henschel mixer (FM75, Mitsui Miike Chemical Engineering Machinery, Co., Ltd.,) at a peripheral velocity of 45 m/sec, and passed through a 54 μm mesh ultrasound shaking sieve to obtain a Toner 1.

Toner Manufacturing Examples 2 to 16

The amounts and types of the resin A, resin B, resin C, resin D and wax, the cooling speed after kneading and the heat-treatment temperature were altered from the Toner manufacturing example 1 as shown in Table 1 to manufacture the Toners 2 to 16. Toners 10 and 11 were manufactured with two stages of cooling speeds after kneading. Toners 14 to 16 were manufactured without using silica fine particles or titania fine particles during kneading. Toner 16 was manufactured without heat treatment with a hot air current. Otherwise, the formulations and conditions were as in Toner manufacturing example 1.

Toner Manufacturing Examples 17 to 23

The amounts and types of the resin A, resin B and resin D and wax and the cooling speed after kneading were altered from the Toner manufacturing example 16 to manufacture the Toners 17 to 23. In toners 17, 18 and 20, a hydrocarbon wax with a melting point of 78° C. was used as the wax. Toner 20 was manufactured with two stages of cooling speeds after kneading. Otherwise, the formulations and conditions were as in Toner manufacturing example 16.

Table 1 shows the material formulations and manufacturing conditions for Toners 1 to 23. In Toners 1 to 23, the crystals of the crystalline polyester resin appeared needle-shaped in TEM observation of the toner cross-sections. Moreover, crystal melting peaks of the crystalline polyester were observed in differential scanning calorimetry of the Toners 1 to 23. The measurement results from cross-sectional observation of the resulting toners are shown in Table 2.

TABLE 1

(Toner formulations and manufacturing conditions)

| Toner No. | Resin A No. | Resin B No. | Crystalline resin No. | Added amount of resin C (mass parts) | Added amount of resin D (mass parts) | Wax melting point (° C.) | Added amount of wax (mass parts) | Kneading rotation speed (rpm) | Kneading discharge temperature (° C.) | Cooling speed after kneading (° C./min) | heat treatment apparatus: Hot air current temperature (° C.) | heat treatment apparatus: Cooling temperature (° C.) |
|---|---|---|---|---|---|---|---|---|---|---|---|---|
| 1 | A1 | B1 | C1 | 7.5 | 5 | 90 | 5 | 350 | 135 | 20 | 135 | 0 |
| 2 | A2 | B2 | C1 | 7.5 | 5 | 90 | 5 | 400 | 135 | 10 | 135 | 0 |
| 3 | A1 | B1 | C1 | 7.5 | 5 | 90 | 5 | 350 | 135 | 15 | 135 | 0 |
| 4 | A2 | B2 | C1 | 7.5 | 5 | 90 | 5 | 420 | 135 | 9 | 135 | 0 |
| 5 | A3 | B3 | C1 | 7.5 | 5 | 90 | 5 | 260 | 135 | 13 | 135 | 0 |
| 6 | A2 | B2 | C1 | 7.5 | 5 | 90 | 5 | 390 | 135 | 12 | 135 | 0 |
| 7 | A1 | B1 | C1 | 7.5 | 5 | 90 | 5 | 390 | 135 | 16 | 135 | 0 |
| 8 | A3 | B3 | C2 | 7.5 | 5.5 | 90 | 5 | 280 | 135 | 12 | 135 | 0 |
| 9 | A3 | B3 | C2 | 7.5 | 5.5 | 90 | 5 | 280 | 135 | 11 | 135 | 0 |
| 10 | A1 | B1 | C1 | 7.5 | 4.5 | 90 | 5 | 350 | 135 | 15→25 | 135 | 0 |
| 11 | A1 | B1 | C1 | 7.5 | 4 | 90 | 5 | 350 | 135 | 12→28 | 135 | 0 |
| 12 | A1 | B1 | C1 | 1 | 1 | 90 | 1 | 390 | 135 | 16 | 135 | 0 |
| 13 | A1 | B1 | C1 | 12 | 7 | 90 | 10 | 390 | 135 | 16 | 135 | 0 |
| 14 | A1 | B1 | C1 | 7.5 | 5 | 90 | 5 | 350 | 135 | 20 | 135 | 0 |
| 15 | A1 | B1 | C1 | 7.5 | 5 | 90 | 5 | 350 | 135 | 20 | 120 | 0 |
| 16 | A1 | B1 | C1 | 7.5 | 5 | 90 | 5 | 350 | 135 | 20 | No treatment | |
| 17 | A1 | B1 | C1 | 7.5 | 5 | 78 | 5 | 250 | 135 | 15 | No treatment | |
| 18 | A1 | B1 | C1 | 7.5 | 5 | 78 | 5 | 280 | 135 | 15 | No treatment | |
| 19 | A3 | B3 | C1 | 7.5 | 4.5 | 90 | 4.5 | 350 | 135 | 13 | No treatment | |
| 20 | A3 | B3 | C1 | 7.5 | 5 | 78 | 5 | 230 | 135 | 10→20 | No treatment | |
| 21 | A2 | B2 | C1 | 7.5 | 5 | 90 | 4.5 | 460 | 135 | 16 | No treatment | |
| 22 | A2 | B2 | C1 | 7.5 | 5 | 90 | 5 | 460 | 135 | 20 | No treatment | |
| 23 | A3 | B3 | C1 | 7.5 | 5 | 90 | 5 | 250 | 135 | 9 | No treatment | |

TABLE 2

(Toner properties)

| Toner No. | Aspect ratio of crystalline polyester | Number-average diameter Dc(nm) | Standard deviation of Dc (nm) | Number-average diameter Dw (nm) | Standard deviation of Dw (nm) | Dc/Dw | Crystalline polyester area ratio (%) | Wax area ratio (%) |
|---|---|---|---|---|---|---|---|---|
| 1 | 12.2 | 122 | 59 | 109 | 76 | 1.12 | 5.5 | 3.6 |
| 2 | 7.4 | 74 | 28 | 73 | 30 | 1.01 | 5.2 | 3.8 |
| 3 | 16.0 | 160 | 82 | 109 | 76 | 1.47 | 5.5 | 3.5 |
| 4 | 7.7 | 77 | 34 | 65 | 24 | 1.18 | 5.1 | 3.7 |
| 5 | 24.7 | 247 | 79 | 236 | 86 | 1.05 | 5.8 | 3.4 |
| 6 | 6.3 | 63 | 21 | 77 | 28 | 0.82 | 5.3 | 3.7 |
| 7 | 14.9 | 149 | 77 | 76 | 28 | 1.96 | 5.5 | 3.8 |
| 8 | 11.2 | 280 | 123 | 178 | 71 | 1.57 | 5.9 | 3.3 |
| 9 | 11.7 | 293 | 111 | 176 | 66 | 1.66 | 5.7 | 3.2 |
| 10 | 12.5 | 125 | 97 | 107 | 98 | 1.17 | 5.6 | 3.9 |
| 11 | 12.1 | 121 | 111 | 109 | 107 | 1.11 | 5.4 | 4.0 |
| 12 | 13.6 | 136 | 72 | 69 | 29 | 1.97 | 0.5 | 0.6 |
| 13 | 15.1 | 151 | 73 | 78 | 27 | 1.94 | 7.9 | 7.6 |
| 14 | 11.9 | 119 | 53 | 102 | 65 | 1.17 | 5.5 | 3.8 |
| 15 | 11.9 | 119 | 53 | 102 | 65 | 1.17 | 5.5 | 3.8 |
| 16 | 11.9 | 119 | 53 | 102 | 65 | 1.17 | 5.5 | 3.8 |
| 17 | 15.7 | 157 | 81 | 220 | 157 | 0.71 | 5.5 | 3.8 |
| 18 | 16.0 | 160 | 82 | 205 | 98 | 0.78 | 5.4 | 3.8 |
| 19 | 24.2 | 242 | 78 | 111 | 78 | 2.18 | 5.8 | 3.1 |
| 20 | 21.0 | 210 | 128 | 249 | 127 | 0.84 | 5.9 | 3.9 |
| 21 | 5.6 | 56 | 37 | 50 | 39 | 1.12 | 5.3 | 3.0 |
| 22 | 4.2 | 42 | 31 | 51 | 41 | 0.82 | 5.2 | 3.5 |
| 23 | 26.5 | 265 | 128 | 222 | 163 | 1.19 | 5.4 | 3.6 |

(Magnetic Core Particle Manufacturing Example)

Step 1 (Weighing and Mixing Step):

Ferrite raw materials were weighed in the following amounts:

| | |
|---|---|
| $Fe_2O_3$ | 60.2 mass % |
| $MnCO_3$ | 33.9 mass % |
| $Mg(OH)_2$ | 4.8 mass % |
| $SrCO_3$ | 1.1 mass % |

These were then pulverized and mixed for 2 hours in a dry ball mill using zirconia (ϕ10 mm) balls.

Step 2 (Pre-Baking Step)

After pulverization and mixing, this was fired for 3 hours at 1000° C. in atmosphere in a burner-type firing furnace to prepare pre-baked ferrite. The ferrite composition was as follows:

$$(MnO)a(MgO)b(SrO)c(Fe_2O_3)d$$

In the formula, a=0.39, b=0.11, c=0.01, d=0.50.

Step 3 (Pulverization Step)

After being pulverized to about 0.5 mm in a crusher, this was pulverized for 2 hours in a wet ball mill using zirconia (ϕ10 mm) balls with 30 mass parts of water added per 100 mass parts of the pre-baked ferrite.

This slurry was pulverized for 4 hours in a wet ball mill using zirconia (ϕ1.0 mm) balls to obtain a ferrite slurry.

Step 4 (Granulation Step)

2.0 mass parts of polyvinyl alcohol per 100 mass parts of the pre-baked slurry was added as a binder to the ferrite slurry, which was then granulated into roughly 36 μm spherical particles in a spray dryer (manufactured by Ohkawara Kakohki Co., Ltd.).

Step 5 (Main Baking Step)

This was then baked for 4 hours at 1150° C. in an electrical oven in a nitrogen atmosphere (oxygen concentration 1.00 vol % or less) to control the baking atmosphere.

Step 6 (Selection Step)

Aggregated particles were crushed, and coarse particles were removed by sieving in a 250 μm mesh sieve to obtain magnetic core particles.

(Coating Resin Manufacturing Example)

| | |
|---|---|
| Cyclohexyl methacrylate monomer | 26.8 mass parts |
| Methyl methacrylate monomer | 0.2 mass parts |
| Methyl methacrylate macromonomer (macromonomer with a weight-average molecular weight of 5000 having methacryloyl group at one end) | 8.4 mass parts |
| Toluene | 31.3 mass parts |
| Methyl ethyl ketone | 31.3 mass parts |

These materials were added to a four-neck flask with an attached reflux condenser, thermometer, nitrogen introduction tube and agitator, and nitrogen gas was introduced to obtain an adequate nitrogen atmosphere. This was then heated to 80° C., 2.0 mass parts of azobisisobutyronitrile were added, and the mixture was refluxed for 5 hours to perform polymerization. Hexane was injected into the resulting reaction product to precipitate the copolymer, and the precipitate was filtered out and vacuum dried to obtain a coating resin.

(Magnetic Carrier Manufacturing Example)

| | |
|---|---|
| Coating resin | 20.0 mass % |
| Toluene | 80.0 mass % |

These materials were dispersed and mixed in a bead mill to obtain a resin liquid.

100 mass parts of the magnetic core particles were placed in a Nauta mixer, and the resin liquid was then added to the Nauta mixer in the amount of 2.0 mass parts of the resin component. This was heated at 70° C. under reduced pressure, mixed at 100 rpm, and subjected to solvent removal and coating for 4 hours. The resulting sample was transferred to a *Julia* mixer, heat treated for 2 hours at 100° C. in a nitrogen atmosphere, and classified with a 70 μm mesh sieve to obtain a magnetic carrier. The 50% particle diameter (D50) of the magnetic carrier based on volume distribution was 38.2 μm.

The above toners 1 to 23 were each mixed with this magnetic carrier in a V-type mixer (V-10: Tokuju Corporation) at 0.5 $s^{-1}$ for 5 minutes to a toner concentration of 8.0 mass % to obtain two-component developers 1 to 23.

Examples 1 to 16, Comparative Examples 1 to 7

The two-component developers 1 to 23 were evaluated according to the following evaluation methods and standards. The evaluation results are shown in Table 3.

(Fixing Member Durability and Contamination Evaluation)

The fixing temperature of a Canon imageRUNNER ADVANCE C9075PRO full color copier was set to 120° C., and an image output durability test was performed in a normal temperature, normal humidity environment (23° C., 50% Rh). The output images were adjusted in monochrome mode so that the reflected density of the cyan on the paper was 1.40 in a 4A landscape image of 10 cm-wide vertical bands of cyan. The evaluation paper was GF-C081 copy paper (A4, weight 81.4 g/$m^2$, purchased from Canon Marketing Japan Inc.). The output images were inspected during the image output durability evaluation, and the contamination level of the fixing member was evaluated based on the number of output sheets at which contamination from toner adhering to the fixing member became visible to the naked eye.

(Evaluation standard: Number of sheets at which a decline in image quality attributable to contamination of the fixing member occurred)

| |
|---|
| A: 150,000 or more (Outstanding) |
| B: 100,000 to less than 150,000 (Excellent) |
| C: 50,000 to less than 100,000 (Very good) |
| D: 20,000 to less than 50,000 (Good) |
| E: 3,000 to less than 20,000 (Normal technical level) |
| F: less than 3,000 (Poor) |

(Toner Tinting Strength Evaluation)

Toner tinting strength was evaluated using the two-component developers 1 to 23 in a normal temperature, normal humidity environment (23° C., 50% Rh) with a Canon imageRUNNER ADVANCE C9075PRO full color copier as the image forming apparatus. Using CS-814 copy paper (A4, weight 81.4 g/$m^2$, purchased from Canon Marketing Japan Inc.) as the evaluation paper, the toner laid-on level (mg/$cm^2$) was measured with the reflected density of the cyan adjusted to 1.40, and evaluated by the following standard. The reflected density was measured using an X-Rite color reflection densitometer (500 Series: X-Rite, Incorporated.).

(Evaluation standard: Toner laid-on level at reflected concentration 1.40)

| |
|---|
| A: Less than 0.275 mg/$cm^2$ (Excellent) |
| B: 0.275 mg/$cm^2$ to less than 0.285 mg/$cm^2$ (Very Good) |
| C: 0.285 mg/$cm^2$ to less than 0.295 mg/$cm^2$ (Good) |
| D: 0.295 mg/$cm^2$ or more (Normal technical level) |

(Developing Apparatus Contamination Evaluation)

Developers 1 to 23 were left for one month in a high-temperature, low-humidity environment (48° C./12% Rh), and a line image output durability test was performed by printing 10,000 sheets with an image ratio of 0.5% on a Canon imageRUNNER ADVANCE C9075PRO full color copier in a normal temperature, normal humidity environment (23° C., 50% Rh). The developer was removed from the developing apparatus without wiping the developing roller after the image output test, and the apparatus was used as the contamination evaluation developing apparatus. A new developer that had been stored in a normal temperature, normal humidity environment (23° C., 50% Rh) was loaded into this contamination evaluation developing apparatus, and used to print solid images on the entire surface of the 4A paper, and changes in image concentration during image output with the new developing apparatus and contamination evaluation developing apparatus were evaluated according to the following standard. The image output settings were set so as to obtain a reflected concentration of 1.40 on the paper with the new developing apparatus. The image concentration was measured using an X-Rite color reflection densitometer (500 Series: X-Rite, Incorporated.).

(Evaluation standard: Image concentration change Δ of the contamination evaluation developing apparatus)

| |
|---|
| A: Less than Δ0.02 (Excellent) |
| B: Δ0.02 to less than Δ0.05 (Very good) |
| C: Δ0.05 to less than Δ0.09 (Good) |
| D: Δ0.09 to less than Δ0.16 (Normal technical level) |
| E: Δ0.16 or more (Poor) |

(Toner Aggregation Evaluation)

The developers 1 to 23 were each left for three months in a high-temperature, high-humidity environment (30° C./95% Rh), 300 sheets of a 4A full-paper halftone image were output using a Canon imageRUNNER ADVANCE C9075PRO full color copier in a normal temperature, normal humidity environment (23° C., 50% Rh), and the number of confirmed toner aggregate blemishes per A4 halftone output image was evaluated. The image output settings were set so as to obtain a reflected density of 0.80 of the halftone image on the paper. The image concentration was measured using an X-Rite color reflection densitometer (500 Series: X-Rite, Incorporated.).

(Evaluation standard: Number of image blemishes per A4 image)

| | |
|---|---|
| A: Less than 0.01 | (Outstanding) |
| B: 0.01 to less than 0.05 | (Excellent) |
| C: 0.05 to less than 0.1 | (Very good) |
| D: 0.1 to less than 0.5 | (Good) |
| E: 0.5 to less than 3.0 | (Normal technical level) |
| F: 3.0 or more | (Poor) |

TABLE 3

(Evaluation results)

| | Developer No. | Toner No. | Fixing member contamination (unit ten thousand sheets) | Tinting strength (mg/cm$^2$) | Developing apparatus contamination (Δ) | Aggregates (per sheet) |
|---|---|---|---|---|---|---|
| Example 1 | 1 | 1 | A (19.3) | A (0.268) | A (0.00) | A (0.00) |
| Example 2 | 2 | 2 | A (16.8) | A (0.268) | A (0.00) | A (0.00) |

TABLE 3-continued (Evaluation results)

| | Developer No. | Toner No. | Fixing member contamination (unit ten thousand sheets) | Tinting strength (mg/cm$^2$) | Developing apparatus contamination (Δ) | Aggregates (per sheet) |
|---|---|---|---|---|---|---|
| Example 3 | 3 | 3 | A (15.9) | A (0.272) | A (0.00) | A (0.00) |
| Example 4 | 4 | 4 | C (7.9) | A (0.267) | A (0.00) | A (0.00) |
| Example 5 | 5 | 5 | C (5.4) | A (0.273) | A (0.01) | A (0.00) |
| Example 6 | 6 | 6 | C (8.6) | A (0.266) | A (0.00) | A (0.00) |
| Example 7 | 7 | 7 | C (7.7) | A (0.271) | A (0.00) | A (0.00) |
| Example 8 | 8 | 8 | B (13.0) | B (0.280) | C (0.06) | A (0.00) |
| Example 9 | 9 | 9 | B (13.1) | C (0.288) | C (0.06) | A (0.00) |
| Example 10 | 10 | 10 | A (17.1) | A (0.270) | B (0.03) | A (0.00) |
| Example 11 | 11 | 11 | A (17.6) | A (0.270) | C (0.08) | A (0.00) |
| Example 12 | 12 | 12 | C (5.1) | A (0.269) | A (0.00) | B (0.02) |
| Example 13 | 13 | 13 | A (17.5) | B (0.282) | B (0.03) | A (0.00) |
| Example 14 | 14 | 14 | B (14.6) | B (0.276) | B (0.02) | A (0.00) |
| Example 15 | 15 | 15 | B (14.7) | B (0.276) | B (0.02) | C (0.07) |
| Example 16 | 16 | 16 | B (14.2) | B (0.279) | B (0.02) | D (0.23) |
| Comparative Example 1 | 17 | 17 | E (1.0) | B (0.277) | D (0.11) | D (0.35) |
| Comparative Example 2 | 18 | 18 | E (1.2) | B (0.276) | B (0.04) | D (0.46) |
| Comparative Example 3 | 19 | 19 | E (1.9) | C (0.286) | B (0.04) | D (0.38) |
| Comparative Example 4 | 20 | 20 | E (0.9) | C (0.286) | D (0.14) | D (0.29) |
| Comparative Example 5 | 21 | 21 | E (1.7) | B (0.275) | B (0.04) | D (0.30) |
| Comparative Example 6 | 22 | 22 | E (1.1) | A (0.273) | B (0.03) | D (0.48) |
| Comparative Example 7 | 23 | 23 | E (1.7) | C (0.289) | D (0.13) | D (0.30) |

These results show that with the present invention it is possible to obtain a toner whereby contamination of the fixing member can be prevented during continuous output with low-temperature fixing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-120215, filed Jun. 15, 2015, which is hereby incorporated by reference herein in its entirety.

What is claimed is:

1. A toner comprising a toner particle containing an amorphous polyester resin, a crystalline polyester resin and a wax, wherein in a cross-section of the toner by transmission electron microscopy (TEM), domains of the wax and crystals of the crystalline polyester resin are present, the area occupied by the domains of the wax is from 0.5% to 8.0% and the area occupied by the crystals of the crystalline polyester resin is from 0.5% to 8.0% of the cross-sectional area of the toner, the number-average diameter (Dw) of the domains of the wax is from 60 nm to 240 nm, the aspect ratio of the crystals of the crystalline polyester resin is from 5.0 to 25.0, and the number-average diameter (Dc) of major axis lengths of the crystals of the crystalline polyester resin is from 0.8 to 2.0 times the number-average diameter (Dw) of the domains of the wax.

2. The toner according to claim 1, wherein the number-average diameter Dc is 280 nm or less.

3. The toner according to claim 1, wherein the standard deviation of the number-average diameter Dw is 100 nm or less, and the standard deviation of the number-average diameter Dc is 100 nm or less.

4. The toner according to claim 1, wherein the toner particle contains an inorganic fine particle as an internal additive.

5. The toner according to claim 1, which has been heat-treated at a temperature at least 40° C. higher than the melting point of the wax.

* * * * *